US006262668B1

(12) United States Patent
Mulvihill et al.

(10) Patent No.: US 6,262,668 B1
(45) Date of Patent: Jul. 17, 2001

(54) DETECTION SYSTEM FOR AN ELECTRONIC ENCLOSURE

(75) Inventors: Timothy M. Mulvihill, Lakeville; George S. Maloof, Jr., Framingham; Arod Shatil, Brookline, all of MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 09/224,968

(22) Filed: Jan. 4, 1999

(51) Int. Cl.[7] ..... G08B 21/00

(52) U.S. Cl. ..... 340/627; 340/630; 340/570; 705/85

(58) Field of Search ..... 340/627, 628, 340/629, 630, 571, 570, 577; 705/85, 188; 700/275; 169/60, 65, 70, 61

(56) References Cited

U.S. PATENT DOCUMENTS

| | | | | |
|---|---|---|---|---|
| 3,915,236 | | 10/1975 | Stichling | 169/61 |
| 4,208,655 | | 6/1980 | Phillips | 340/627 |
| 4,675,661 | | 6/1987 | Ishii | 340/630 |
| 4,692,750 | | 9/1987 | Murakami et al. | 340/588 |
| 4,749,871 | * | 6/1988 | Galvin | 250/573 |
| 4,785,288 | * | 11/1988 | Heberlein | 340/627 |
| 4,827,247 | * | 5/1989 | Giffone | 340/630 |
| 4,977,527 | * | 12/1990 | Shaw et al. | 364/571.03 |
| 5,093,651 | * | 3/1992 | Thomas | 340/628 |
| 5,552,765 | * | 9/1996 | Vane | 340/515 |
| 5,936,531 | * | 8/1999 | Powers | 340/628 |
| 6,005,235 | | 12/1999 | Shin | 219/757 |
| 6,046,441 | * | 4/2000 | Daffron | 340/628 |

* cited by examiner

*Primary Examiner*—Jeffery Hofsass
*Assistant Examiner*—Anh La
(74) *Attorney, Agent, or Firm*—Wolf, Greenfield & Sacks, P.C.

(57) ABSTRACT

A method and apparatus is provided for detecting airborne particles in an electronic enclosure. The electronic enclosure may be used to house one or more electronic devices or components of an electronic system, such as a computer or data storage system. A particle detection system is provided to monitor the air within the enclosure and to generate an alarm signal in response to detection of a threshold level of airborne particles within the enclosure that is indicative of an operational anomaly associated with at least one of the electronic devices or components. In response to the alarm signal, the electronic devices housed within the enclosure may be automatically shut down to reduce potential damage to at least the devices housed within the enclosure. The detection system is particularly suited for detecting the presence of smoke within an electronic enclosure, such as may be generated during a combustion event by overheated or electrically shorted electronic components.

18 Claims, 8 Drawing Sheets

DETECTION SYSTEM FOR AN ELECTRONIC ENCLOSURE

BACKGROUND OF THE INVENTION

1. Field of the Invention

The present invention relates to a method and apparatus for detecting airborne articles, and more particularly, for responding to detection of smoke from an electronic enclosure.

2. Description of Related Art

An electronic system, such as a computer system, is conventionally comprised of various electronic devices or components, including peripheral devices such as disk drives, that are mounted and electrically interconnected within one or more electronic enclosures or cabinets. In many applications, such as commercial business operations, each of the electronic enclosures for the system is installed in a room of a building or other structure that provides a controlled environment for system operation. Since electronic systems can dissipate a large amount of heat, ventilation is generally provided for removing the heat from both the cabinets and the room to avoid creating a high temperature condition that could result in a system failure.

Electronic devices, if allowed to overheat, are susceptible to malfunctions or permanent damage. In more extreme situations, an overheated device could potentially initiate a fire within an enclosure that, unless detected and suppressed, could cause extensive damage, not only to the particular enclosure, but also to nearby enclosures and possibly to the room. An overheated device may be caused by various factors, such as inadequate cooling, electrical short circuits or the like.

One scheme for detecting a potential fire event associated with an electronic system involves the placement of one or more smoke detectors within the ventilation system of the room. Air drawn from the room through the ventilation system is monitored by the smoke detector. When an unacceptable amount of smoke is detected, the smoke detector typically generates an alarm signal that may be either presented to a human operator for investigation and response or used to automatically terminate electrical power to the entire room. In some instances, a fire suppressant may be automatically discharged into the room.

Applicants have recognized that such a detection scheme suffers from several drawbacks. For example, this scheme lacks an ability to isolate and shut down only the particular source of a smoke event. Rather, electrical power is typically interrupted for the entire room, thereby shutting down each system or subsystem of equipment housed within the room until the source of the smoke event can be identified and rectified. Such action is undesirable to an enterprise, such as a bank, a telephone company or an airline, which relies upon continuous access to its computer and data storage systems.

A room monitoring scheme may also experience delay in detecting a smoke event which could potentially result in more extensive damage as the length of the delay increases. This could lead to damage not only to the equipment that is the source of the smoke, but also to surrounding equipment should the event lead to a spreading fire. Depending on the particular room configuration, the smoke detector may be located a significant distance away from the source of the smoke, thereby increasing the amount of time that the event could be allowed to continue before its detection. Additionally, the dilution of smoke particles within the ventilation air for the entire room may lower the concentration of particles in the air monitored by the detector which could also delay the detection of a smoke event.

It is an object of the present invention to provide an improved method and apparatus for detecting and responding to the presence of airborne particles, such as smoke, generated within an electronic enclosure.

SUMMARY

In one illustrative embodiment of the invention, a method is provided in a system including a sensor and an electronic enclosure housing at least one electronic component therein. The method comprises steps of: (A) monitoring an output of the sensor that indicates the presence of an operational anomaly with the at least one electronic component; and (B) when the output of the sensor indicates the presence of an operational anomaly with the at least one electronic component, performing steps of: (1) determining whether a fault condition is present with respect to the sensor; (2) disregarding the indication of the presence of an operational anomaly with the at least one electronic component when a fault condition is determined to be present with respect to the sensor; and (3) performing an action with respect to the at least one electronic component when no fault condition is determined to be present with respect to the sensor.

In another illustrative embodiment of the invention, a computer readable medium encoded with a program is provided for execution on a processor in a detection system for use with a computer system including a sensor and an electronic enclosure housing at least one electronic component therein. The program, when executed on the processor, performs a method comprising steps of: (A) monitoring an output of the sensor that indicates the presence of an operational anomaly with the at least one electronic component; and (B) when the output of the sensor indicates the presence of an operational anomaly with the at least one electronic component, performing steps of: (1) determining whether a fault condition is present with respect to the sensor; (2) disregarding the indication of the presence of an operational anomaly with the at least one electronic component when a fault condition is determined to be present with respect to the sensor; and (3) performing an action with respect to the at least one electronic component when no fault condition is determined to be present with respect to the sensor.

In a further illustrative embodiment of the invention, a detection system is provided for use with a computer system including a sensor and an electronic enclosure housing at least one electronic component therein. The detection system comprises a detector to monitor an output of the sensor that indicates the presence of an operational anomaly with the at least one electronic component; and a controller. When the output of the sensor indicates the presence of an operational anomaly with the at least one electronic component, the controller determines whether a fault condition is present with respect to the sensor; disregards the indication of the presence of an operational anomaly with the at least one electronic component when a fault condition is determined to be present with respect to the sensor; and performs an action with respect to the at least one electronic component when no fault condition is determined to be present with respect to the sensor.

BRIEF DESCRIPTION OF THE DRAWINGS

The foregoing and other objects and advantages of the present invention will become apparent with reference to the following detailed description when taken in conjunction with the accompanying drawings in which.

DETAILED DESCRIPTION

The present invention is directed to a method and apparatus for detecting the presence of airborne particles generated within an electronic enclosure or cabinet. The electronic enclosure may be used to house one or more electronic devices or components of an electronic system, such as a computer or data storage system. A particle detection system is provided to monitor the air within the enclosure and to generate an alarm signal in response to detection of a level of airborne particles within the enclosure that is indicative of an operational anomaly associated with at least one of the electronic devices or components. In response to the alarm signal, the electronic devices housed within the enclosure may be automatically shut down to reduce potential damage to at least the devices housed within the enclosure.

The detection system is particularly suited for detecting the presence of smoke within an electronic enclosure, such as may be generated during a combustion event by overheated or electrically shorted electronic components. For example, the smoke detection system may be configured to detect small amounts of smoke and particles generated by overheating component insulation. By monitoring the air received directly from an enclosure, the smoke detection system advantageously isolates the source of a smoke event to a particular enclosure, thereby allowing corrective action to be taken, such as terminating power to the electronic devices within the particular enclosure. Such corrective action may be undertaken without affecting the operation of other electronic devices housed in separate electronic enclosures within the same room. Accordingly, for ease of understanding, and without limiting the scope of the invention, the airborne particle detection system is hereinafter described as a smoke detection system for an electronic enclosure. However, the airborne particle detection system may be used to detect other types of airborne particles.

Figure 1:
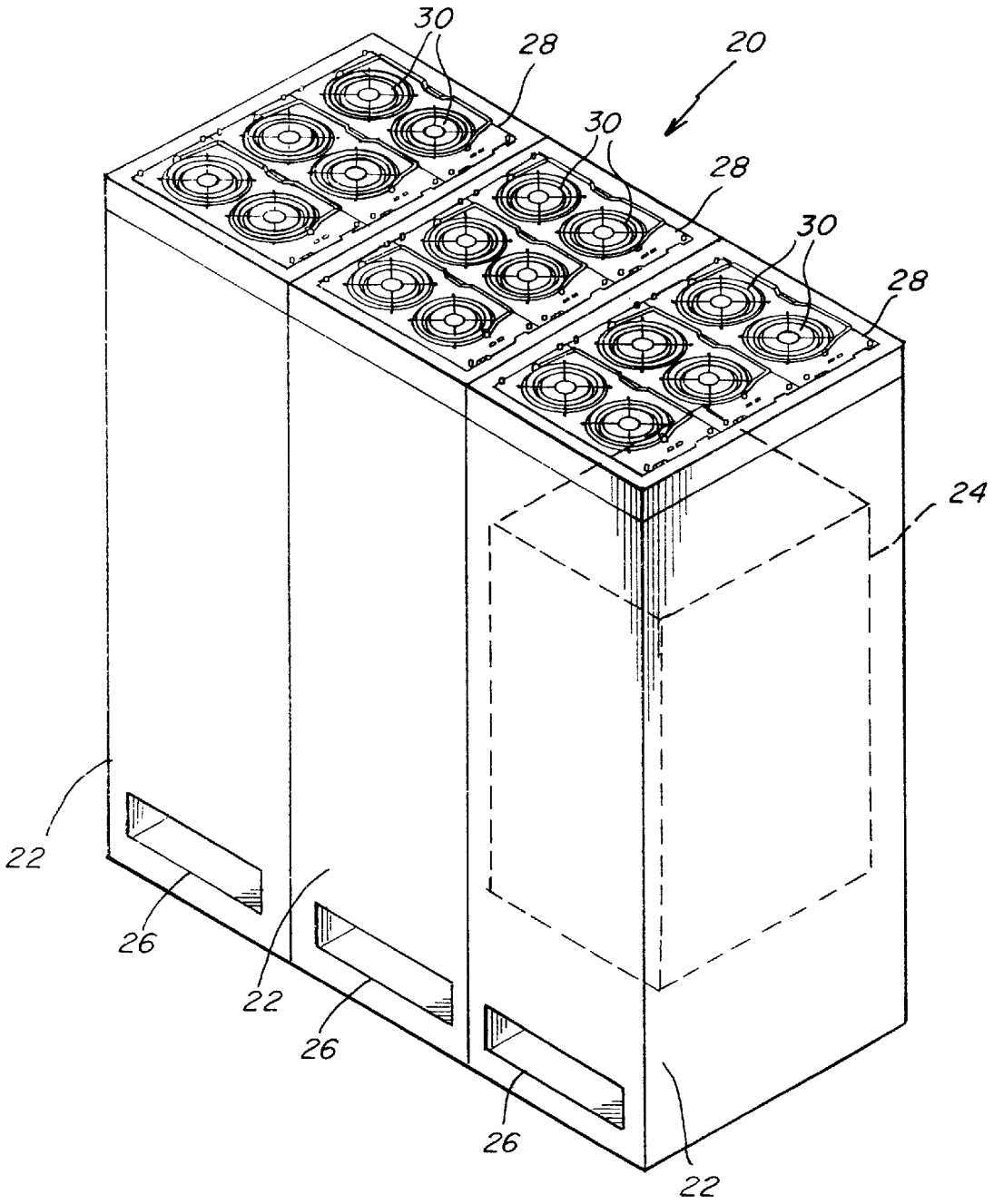
FIG. 1 is a perspective view of an electronic system incorporating a smoke detection system according to one illustrative embodiment of the present invention.

An illustrative electronic system 20, as shown in FIG. 1, may be comprised of one or more electronic enclosures 22 or cabinets that house various electronic components 24 or devices of the system. It is to be understood that the smoke detection system may be implemented for each or fewer than all of the enclosures 22 of the electronic system 20.

In one illustrative embodiment, an electronic enclosure 22 includes an air inlet 26 at the lower portion of its front panel and an air outlet 28 at its top panel. Cooling fans 30 are mounted in the enclosure 22 at the air outlet 28 and are operated to draw cooling air, via the inlet 26, along a flow path through the enclosure to cool the electronic devices 24 or components. As the air passes through the enclosure 22, it carries the heat dissipated by the electronics 24 out of the enclosure through the air outlet 28. It is to be understood that the locations of the air inlet 26 and air outlet 28 can be varied to suit the specific needs of the system.

The enclosure 22 may be suitably configured to mount electronic devices 24, such as computers, disk drives, circuit card assemblies and the like, within the enclosure. Of course, it is to be appreciated that the enclosure may be configured in any suitable manner to accommodate any electronic device therein.

Figure 2:
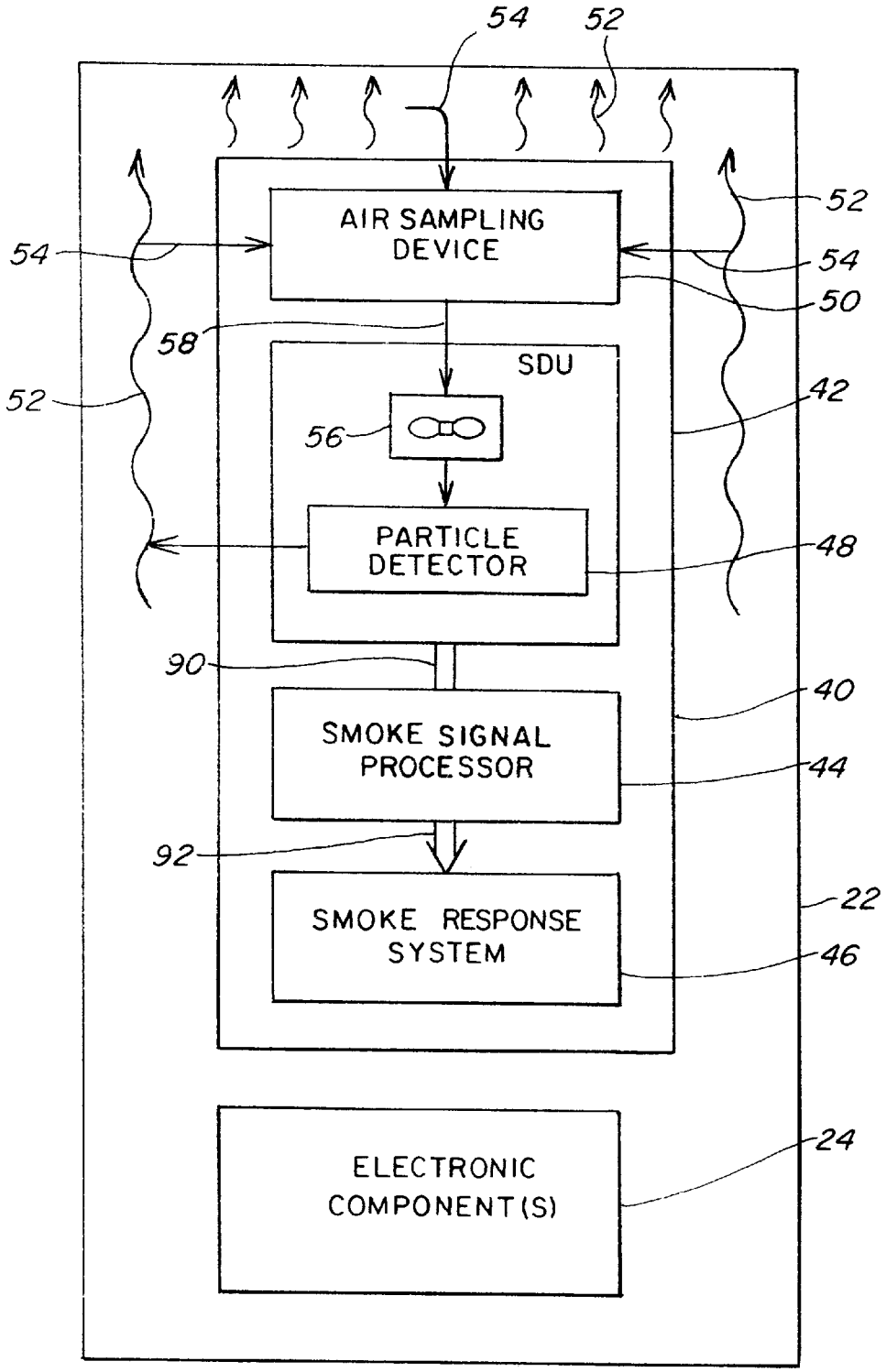
FIG. 2 is a block diagram of the smoke detection system according to one illustrative embodiment of the invention.
Figure 3:
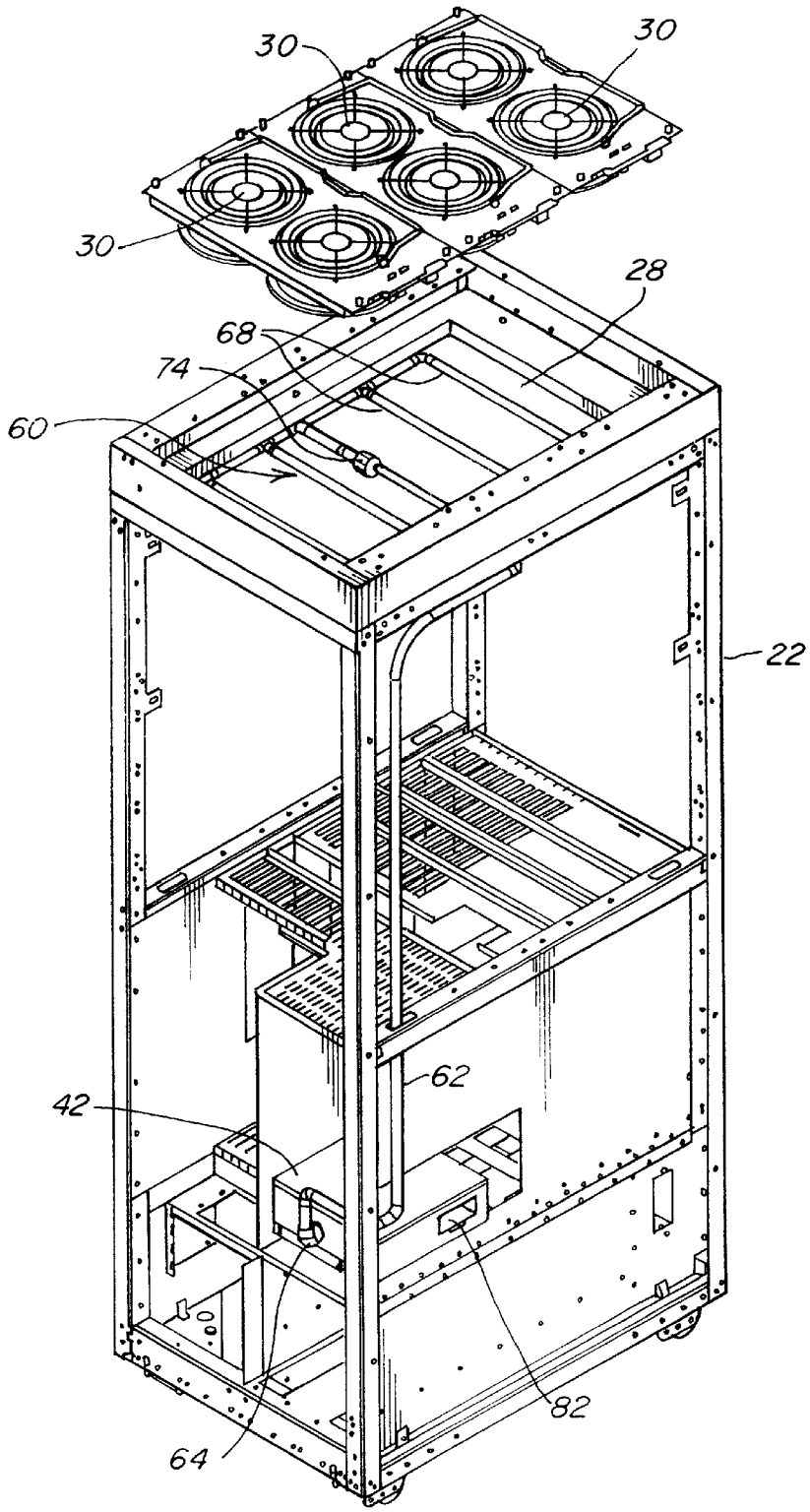
FIG. 3 is a partially exploded perspective view of an electronic enclosure, with its outer panels removed, illustrating an implementation of the smoke detection system according to one illustrative embodiment of the present invention.

In one illustrative embodiment of the invention as shown in FIGS. 2–3, the smoke detection system 40 includes a smoke detector unit (SDU) 42 that is fluidly coupled to the enclosure 22 to receive air directly from the enclosure to reduce the likelihood that the monitored air contains particles from other sources. The SDU 42 is configured to monitor the air and to provide information descriptive of the air to a smoke signal processor 44 via a coupling 90. The smoke signal processor 44 processes the information provided to it by the SDU and instructs a smoke response system 46 via a coupling 92 to respond based on the results of the processing, as described in more detail below with respect to FIGS. 7 and 8.

As illustrated in FIG. 2, each component of the smoke detection system 40 may be mounted within the enclosure 22 to provide a self-contained smoke detection system dedicated to the enclosure. It is to be understood, however, that any component of the smoke detection system may be located anywhere, including outside the enclosure. Even for the embodiment of the present invention wherein the SDU is fluidly coupled to the enclosure to monitor air received directly from the enclosure, the SDU and other components can be located outside the enclosure.

In one embodiment as schematically shown in FIG. 2, the SDU 42 includes a laser particle detector 48 and associated electronics (not shown) for detecting smoke particles and generating the alarm signal. In one embodiment, the particle detector 48 may include a class IIIB, infrared laser operating at 10 mW maximum power with a detector head sensitivity ranging from approximately 0.003% to approximately 0.03% per foot obscuration. One example of an SDU suitable for the smoke detection system 40 is an AnaLASER high sensitivity smoke detection (HSSD) unit, part no. 89-400000-001, available from Kidde-Fenwal, Inc., Fenwal Protection Systems of Ashland, Mass. It is to be understood, however, that numerous other types of SDUs may be used in the smoke detection system.

The smoke detection system 40 may include an air sampling device 50 that is configured to be placed in the flow path 52 of the air through the enclosure 22 to sample the air at one or more locations 54. The SDU 42 is fluidly coupled 58 to the air sampling device 50 to receive and monitor the air. In one illustrative embodiment, as shown in FIG. 2, the SDU 42 includes an air moving device 56, such as a centrifugal blower, that continuously draws an air sample from the enclosure into the SDU through the air sampling device 50. For example, the SDU 42 has the capacity to draw air at a flow rate of approximately 23.5 CFM. It is to be appreciated, however, that any suitable air moving device, such as an axial fan or the like, may be used to draw air into the SDU. Further, the air moving device, if even necessary, may be provided at any suitable location between the air sampling device and the SDU.

As illustrated in FIG. 3, the air sampling device 50 may be located at the air outlet 28 of the enclosure 22 below the cooling fans 30. This location is particularly advantageous since substantially all the air passing through the enclosure is exhausted through the air outlet 28. Smoke generated essentially anywhere within the enclosure 22 is carried to the outlet 28 where it can be readily captured by the air sampling device 50 and directed to the SDU. It is to be appreciated, however, that air may be taken from any suitable location within the enclosure. For example, it may be desirable to locate at least a portion of the air sampling device 50 in close proximity to a particular device within the enclosure.

Figure 4:
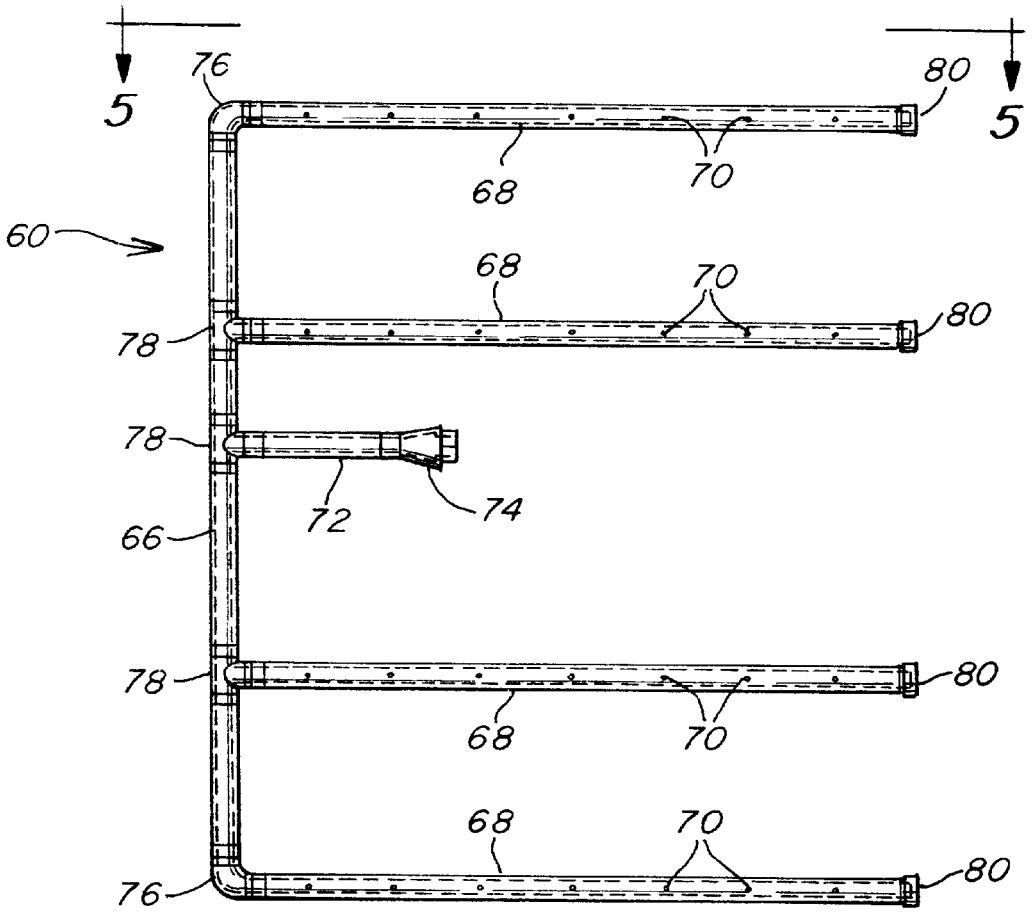
FIG. 4 is a bottom plan view of an illustrative embodiment of an air sampling device for use in the smoke detection system of FIG. 3.
Figure 5:
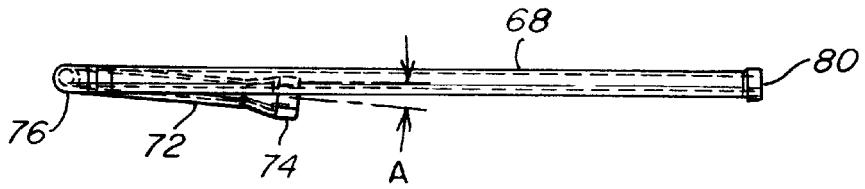
FIG. 5 is a side view of the air sampling device take along view line 5—5 of FIG. 4.

In one illustrative embodiment shown in FIGS. 3–5, the air sampling device 50 includes a manifold 60 that is coupled to the SDU 42 with a supply conduit 62 connected to the SDU air inlet 64. The manifold 60 may include a header 66 and one or more intake tubes 68 extending laterally away from the header. Each intake tube 68 is perforated with one or more intake ports 70 along its length to capture at least a portion of the air flowing upwardly through the enclosure. The manifold 60 also includes an outlet tube 72 that is adapted to connect the supply conduit 62 to the manifold. As illustrated in FIG. 5, the outlet tube 72 is offset from the intake tubes by an angle A to facilitate connection of the supply conduit 62 to the manifold.

The particular configuration of the manifold 60 is generally a function of the flow characteristics of the air through the electronic enclosure 22. For example, the intake tubes 68 are preferably located at or in close proximity to air flow channels through the enclosure. As illustrated, the intake tubes 68 extend across the width of the air outlet 28 and have a plurality of spaced intake ports 70 to increase the sampling area of the manifold, thereby increasing the likelihood of detecting a smoke event anywhere within the enclosure. It is contemplated that the smoke detection system may incorporate any suitable manifold configuration.

In one embodiment, each intake tube 68 has a length of approximately 17.0 inches and is perforated with a series of intake ports 70 (for example, seven ports) having a diameter of approximately 0.093 inches that are spaced approximately 2.0 to 2.5 inches apart along its length. The outlet tube 72 is offset by an angle A of approximately 4° from the intake tubes 68 and may include a threaded coupling 74 that is adapted to mate with a corresponding coupling on the supply conduit 62. A pair of outer intake tubes 68 are located at the opposing ends of the header 66 approximately 19.7 inches apart with a pair of inner intake tubes 68 spaced approximately 5.5 inches away from the outer intake tubes. Each of the header 66, intake tubes 68 and outlet tube 72 has an inner diameter of approximately 0.5 inches. This exemplary manifold configuration is particularly suited for use with either the Symmetrix 3430 or Symmetrix 5430 data storage devices, available from EMC Corporation of Hopkinton, Mass. It is to be understood, however, that any suitable manifold configuration may be used in the smoke detection system to accommodate other enclosure configurations.

The header 66, intake tubes 68 and outlet tube 72 may be formed of a rigid material, such as copper, aluminum, plastic or like tubing, that are joined together with fittings, such as 90° elbows 76 and "T" unions 78, to form a fluid tight manifold. Electrical insulation, such as shrink sleeving, may be provided over portions of the manifold to reduce the risk of electrical short circuits, particularly when the manifold is constructed of a metal material. Each intake tube 68 may be sealed with an end cap 80. The supply conduit 62 may be formed of a flexible liquid tight tubing and corresponding connectors, such as Heyco-Flex II tubing and connectors available from Heyco Molded Products of Kenilworth, N.J. It is to be appreciated, however, that the manifold and the supply conduit may be formed in any suitable manner using any suitable material.

As illustrated in FIG. 3, the air delivered to the SDU 42 is exhausted directly into the enclosure through an air exhaust 82 in the SDU. In some applications, however, it may be desirable to direct the air exhausted from the SDU to a particular location either inside or outside the enclosure. For example, in some instances, the pressure at the air exhaust 82 of the SDU may affect the air flow through the smoke detection system. It is contemplated that the exhaust from the SDU may be carried to a location having particular pressure characteristics to enhance the air flow through the SDU.

Figure 6:
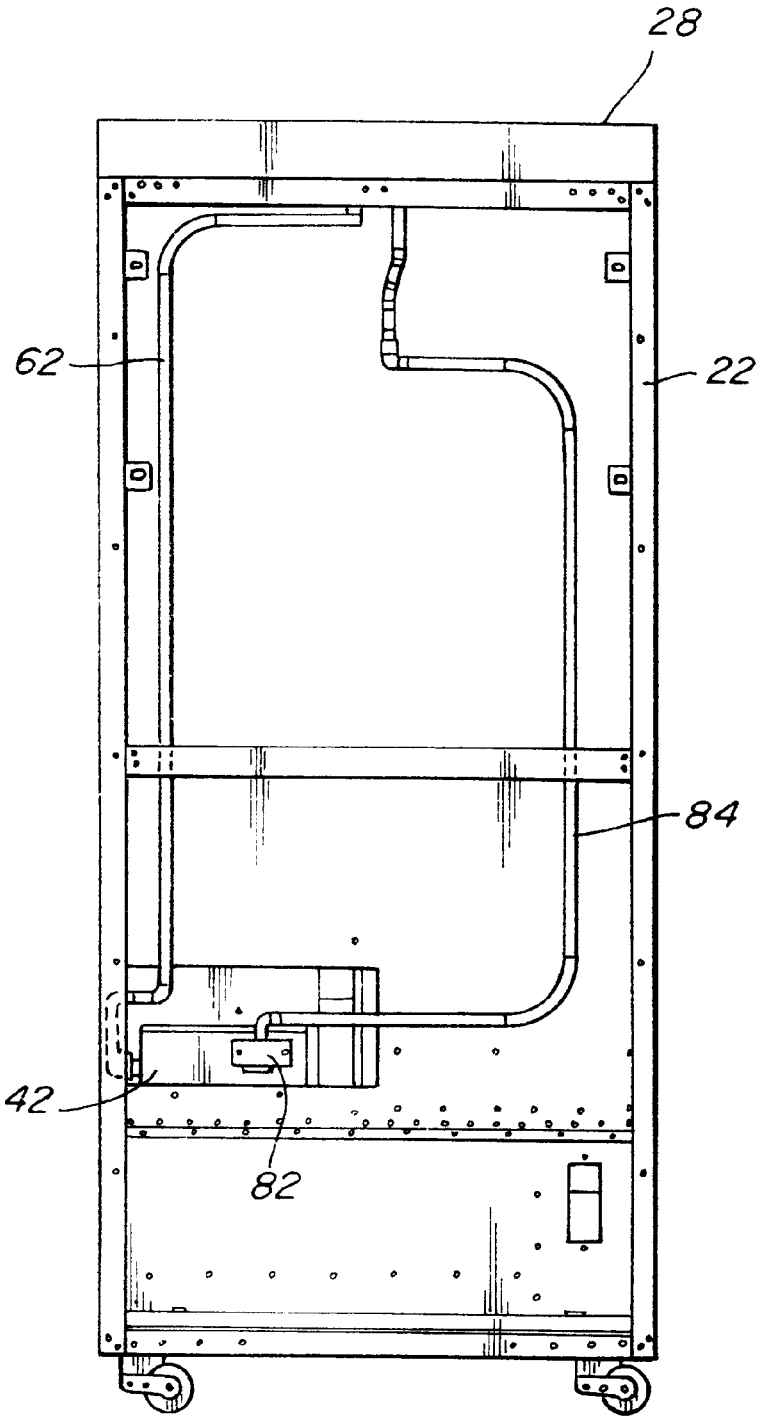
FIG. 6 is a side elevational view of an electronic enclosure, with its side panel removed, illustrating an implementation of an exhaust conduit in a smoke detection system according to another illustrative embodiment of the present invention.

In another illustrative embodiment of the invention shown in FIG. 6, the smoke detection system includes an exhaust conduit 84 to carry the SDU exhaust to the air outlet 28 of the enclosure adjacent the air sampling device 50. This arrangement allows the SDU to sample air from and exhaust air to essentially a common location of the enclosure 22. The exhaust conduit 84 may be formed of tubing similar to the inlet conduit 62 as described above. It is to be understood, however, that the exhaust conduit 84 may be configured in any suitable manner using any suitable material.

As indicated above, the SDU 42 may be any suitable smoke detection unit capable of detecting smoke present within the air of the electronic enclosure 22 and supplying information about the air to a smoke signal processor 44. As illustrated in FIG. 2, the SDU 42 may be coupled to the smoke signal processor 44 using any suitable logical and/or physical coupling 90 capable of transferring information from the SDU to the smoke signal processor. For example, the coupling 90 may include a cable having one or more lines configured to carry information according to the RS-232 standard. As another example, particularly when aspects of the SDU and the smoke signal processor are implemented in software, the coupling may be a logical coupling including an application program interface (API) or other software interface.

The smoke signal processor 44 may be implemented in any suitable manner including hardware, software or a combination thereof. For example, the smoke signal processor 44 may include software running on a central processing unit (CPU) housed within the electronic enclosure 22. It is to be understood, however, that the smoke signal processor 44 may be located anywhere, including outside the enclosure, so long as the smoke signal processor is logically and/or physically coupled to the SDU. For example, the smoke signal processor 44 may include hardware, software or a combination thereof that is in communication with the SDU 42 over a network.

As previously mentioned, the SDU 42 monitors air it receives from the enclosure 22 via the air sampling device 50 and provides information descriptive of the air to the smoke signal processor 44. The SDU 42 may also be configured to provide additional information, such as system configuration information, to the smoke signal processor 44, as described more fully below. The SDU 42 may be configured to transmit some or all of this information to the smoke signal processor 44 on a periodic basis, in response to a smoke event and/or when requested by the smoke signal processor 44 in response to an event, such as the receipt of a smoke event signal. The various information may be provided to the smoke signal processor 44 individually or together in a single packet. If information is sent to the smoke signal processor 44 in a packet, the packet may contain information such as the length of the packet and information descriptive of the protocol used to send the packet.

Figure 7:
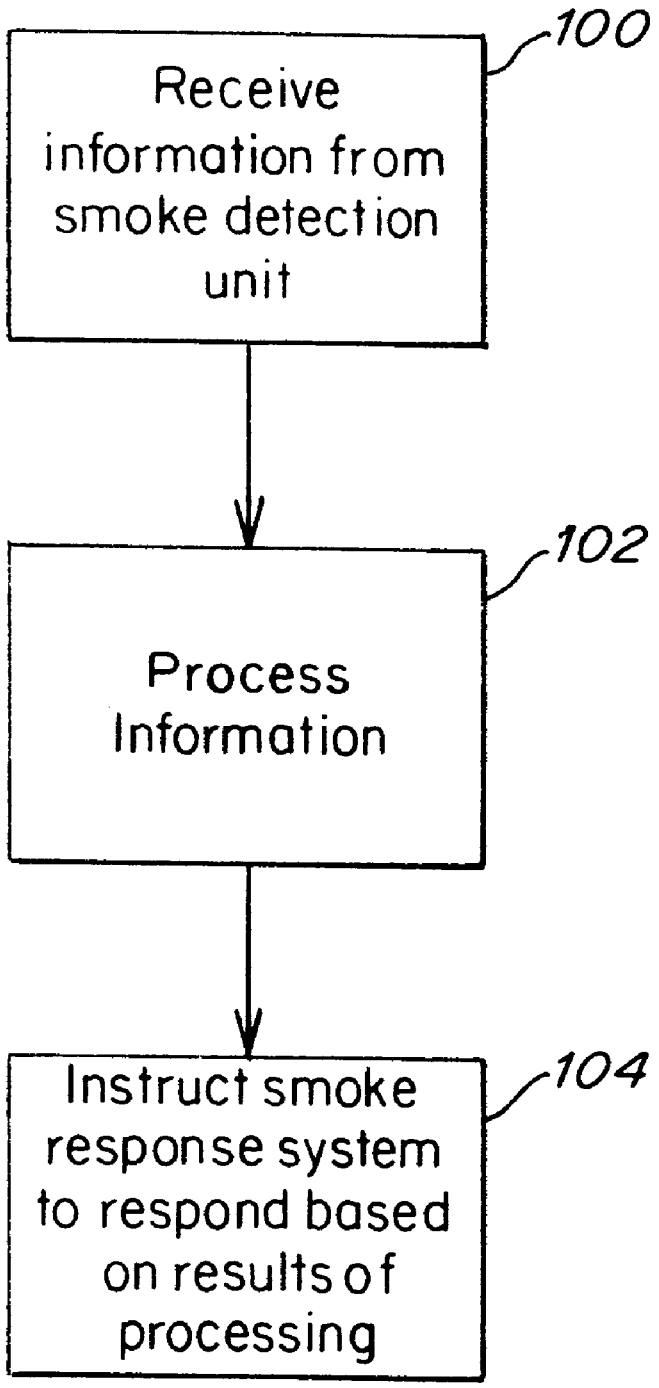
FIGS. 7 and 8 are flow charts of methods performed by a signal processor for processing smoke signal information received from the smoke detection unit of FIG. 2.

As shown in FIG. 7, the information provided by the SDU 42 is received by the smoke signal processor 44 (step 100) and processed by the smoke signal processor 44 (step 102) to determine what type of response, if any, should be carried out by the smoke response system 46. The smoke signal processor 44 instructs the smoke response system 46 to carry out the desired response (step 104), which may include, but is not limited to, taking no action, initiating a shutdown sequence to terminate power to the electronics 24 within the enclosure 22 and/or sending a message to a human operator (referred to as a "call home"), as described in more detail below.

The smoke signal processor 44 may also be configured to further process the information provided by the SDU, such as by recording the information in a chronological log, or by performing additional processing to independently determine whether there is an excessive level of smoke within the electronic enclosure.

The smoke response system 46 may be implemented in any suitable manner including hardware, software or a combination thereof. For example, the smoke response system 46 may include software running on a central processing unit (CPU) housed within the electronic enclosure 22. It is to be understood, however, that the smoke response system 46 may be located anywhere, including outside the enclosure, as long as the smoke response system is logically and/or physically coupled to the smoke signal processor 44. For example, the smoke response system 46 may be implemented in the smoke signal processor 44. The coupling 92 between the smoke signal processor 44 and the smoke response system 46 may be a hardware coupling, a software coupling, or any combination thereof.

As indicated above, the SDU 42 may be configured to generate and provide various types of information, such as information related to the air within the electronic enclosure 22, and information related to the configuration of the SDU 42, as described in more detail below. This information may be processed by the smoke signal processor 44 to determine the type of response, if any, to be carried out by the smoke response system 46. The information may include, but is not limited to, a smoke signal event, level of smoke in the air, SDU configuration, SDU operation, and signal integrity information.

For example, when the SDU 42 generates a smoke event signal in response to detection of smoke in the air, the smoke signal processor 44 may instruct the smoke response system 46 to terminate power to the electronics 24 within the electronic enclosure 22 by initiating a shutdown sequence. The shutdown sequence may include one or more system responses prior to terminating the power to the electronic devices housed within the electronic enclosure. For example, if the electronic enclosure 22 houses a cached storage system including storage devices, such as hard disk drives, the smoke response system 46 may begin saving any unsaved cache data to the storage devices before terminating the power. In one embodiment, as much data as possible are saved from the caches during a predetermined time period, after which power is terminated to the electronics. Power is terminated after saving the cached data for the predetermined time period to reduce the risk of fire within the enclosure. The predetermined time period for saving the cached data may, for example, be 20–30 seconds before power is terminated.

The level of smoke in the air may be measured in terms of the concentration of smoke particles that are detected within the air. The SDU 42 may be configured to monitor the air for the presence of airborne particles having a predetermined range of particle sizes corresponding to smoke, thereby reducing the potential impact of other airborne particles, such as dust, on the detection system. If desired, a human operator may cause the smoke signal processor 44 to reconfigure the range to detect airborne particles of other sizes, such as particles other than smoke particles.

The SDU 42 may generate a smoke event signal and transmit the smoke event signal to the smoke signal processor 44 when the SDU 42 detects an unacceptable level of smoke in the air. For example, the SDU 42 may be configured with a smoke threshold descriptive of a level of smoke and with an alarm delay corresponding to a duration of time. The SDU 42 may (generate a smoke event signal when the level of smoke detected in the air samples exceeds the smoke threshold for longer than the alarm delay. It is to be appreciated, however, that the SDU 42 may use any other method for determining when there is an unacceptable level of smoke in the air and when, as a result, to generate the smoke event signal. Further, the smoke signal processor 44 may also process the information received from the SDU 42 (step 100) to independently determine the presence of an unacceptable level of smoke in the air and to instruct the smoke response system 46 to respond with an appropriate action.

The SDU 42 configuration information may include information descriptive of the smoke detector, such as a serial number or a version number of hardware, software, or firmware within the SDU 42. When the smoke signal processor 44 receives a value for such a piece of information that is different than a previously received value, the smoke signal processor 44 may instruct the smoke response system 46 to take an appropriate action, such as generating a call home. A disparity between two received values may be an indication of a fault condition with respect to the SDU 42, a fault condition with respect to the coupling 90 between the SDU 42 and the smoke signal processor 44, or of some other change within the electronic enclosure 22 that may require the attention of a human operator or reconfiguration of the SDU 42 or smoke signal processor 44.

For example, when the smoke signal processor 44 first communicates with the SDU 42, the smoke signal processor may record the version number or serial number received from the SDU 42. If a version number or serial number subsequently received by the smoke signal processor 44 is not the same as the originally recorded version number or serial number, respectively, the smoke signal processor 44 may instruct the smoke response system 46 to generate a call home.

The SDU operational information may include, but is not limited to, a low flow flag, a high flow flag, and a unit isolation flag. The low flow flag indicates whether the rate of air flow through the smoke detector 48 is sufficient to provide a reliable smoke level reading. The high flow flag indicates whether the rate of air flow through the smoke detector 48 is too high to provide a reliable smoke level reading. The unit isolation flag indicates where there is a problem with the coupling 90 between the SDU 42 and the smoke signal processor 44. If any of these flags are asserted, the smoke signal processor 44 may determine that other information provided by the SDU 42, such as the smoke level reading or the smoke event signal, is not reliable. In response, the smoke signal processor 44 may ignore the smoke event signal or instruct the smoke response system 46 to generate a call home. Ignoring the smoke event signal when any of the flags are asserted advantageously makes it possible to avoid an inadvertent shutdown of the electronics 24.

As described above, the SDU 42 may send items of information to the smoke signal processor 44 individually or together in a single packet. When the SDU 42 sends a packet of information to the smoke signal processor 44, the SDU 42 may be configured to provide means for verifying the accurate transmission of the packet. For example, the SDU 42 may provide the packet with a checksum corresponding to a function (such as a sum) of all of the information contained within the packet. When the smoke signal processor 44 receives the packet, the smoke signal processor 44 may verify that the checksum corresponds to the sum of 20 the information contained in the packet. If the verification fails, the smoke signal processor 44 may instruct the smoke response system 46 to take an appropriate action, such as generating a call home or initiating a shutdown sequence.

If the smoke signal processor 44 fails to properly receive the packet from the SDU 42, the smoke signal processor 44 may instruct the smoke response system 46 to take an appropriate action, such as generating a call home. The smoke signal processor 44 may attempt to receive the packet several times before initiating a call home. Failure to properly receive information from the SDU 42 may be an indication of a problem with the SDU 42 or a problem with the coupling 90 between the SDU 42 and the smoke signal processor 44.

As indicated above, the smoke response system 46 may generate a call home as one possible response to the particular information received by the smoke signal processor 44. A call home response may be any message transmitted to a human operator to alert the human operator to the potential problem. For example, the call home may be a telephone call to a human administrator using a modem, and may include information received by the smoke signal processor 44 from the SDU 42.

A call home may be used to provide information about the air within an electronic enclosure to a human operator for further analysis. The human operator may, for example, decide to terminate power to the electronic devices housed within the electronic enclosure. Since the human operator can easily and quickly isolate the particular electronic enclosure associated with a smoke event, the smoke detection system 40 may reduce the overall disruption to the electronic system operations caused by a smoke event within the electronic enclosure 22.

The smoke signal processor 44 may configure various aspects of the SDU 42 by, for example, sending configuration commands to the SDU 42. For example, the smoke signal processor 44 may change the values of the smoke threshold and the alarm delay. The smoke signal processor 44 may also, for example, reset the SDU 42 so that variables such as the smoke threshold and alarm delay are reset to their default values. The smoke signal processor 44 may also request configuration information from the SDU 42, such as the current value of the smoke level threshold, alarm delay, serial number, or version number.

The smoke signal processor 44 may interact with a user through an interface, such as a graphical user interface. The interface may allow the user to view information obtained from the SDU 42 (such as current or previous smoke level readings), to configure the SDU 42 (such as the values of the smoke threshold and the alarm delay), to request information from the SDU 42, and to send instructions to the smoke response system 46 (such as an instruction to initiate a shutdown sequence).

Figure 8:
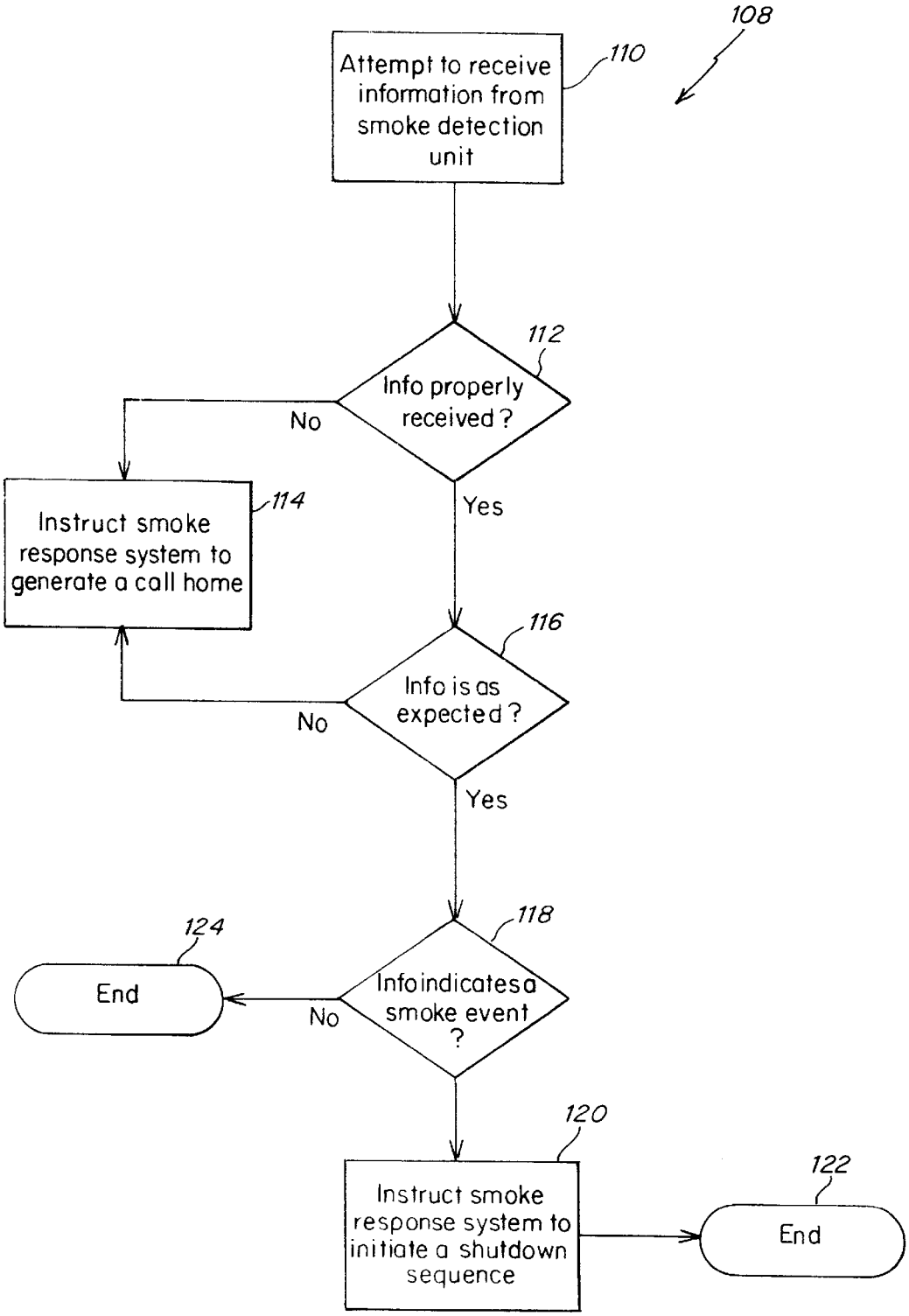

In one illustrative embodiment of the present invention shown in FIG. 8, a process 108 is provided for determining how the smoke response system 46 should respond to information received by the smoke signal processor 44. The smoke signal processor 44 attempts to receive information from the smoke detection unit 42 (step 110). When the information is not properly received (e.g., if a request for a packet is not answered within a predetermined amount of time) (step 112), the smoke signal processor 44 instructs the smoke response system 46 to generate a call home (step 114). When the smoke signal processor 44 properly receives the information from the SDU 42, but any of the information received is not what was expected (step 116), the smoke signal processor 44 instructs the smoke response system 46 to generate a call home (step 114). If the information is properly received and all information is what was expected (step 112 and 116), then the smoke signal processor 44 determines (step 118) whether the information indicates that a smoke event has occurred. If the smoke signal processor 44 determines that a smoke event has occurred, the smoke signal processor 44 instructs the smoke response system 46 to initiate a shutdown sequence to terminate power to the electronics (120), and the process 108 terminates (step 122); otherwise, the process 108 terminates without instructing the smoke response system to take any action (step 124).

Figure 9:
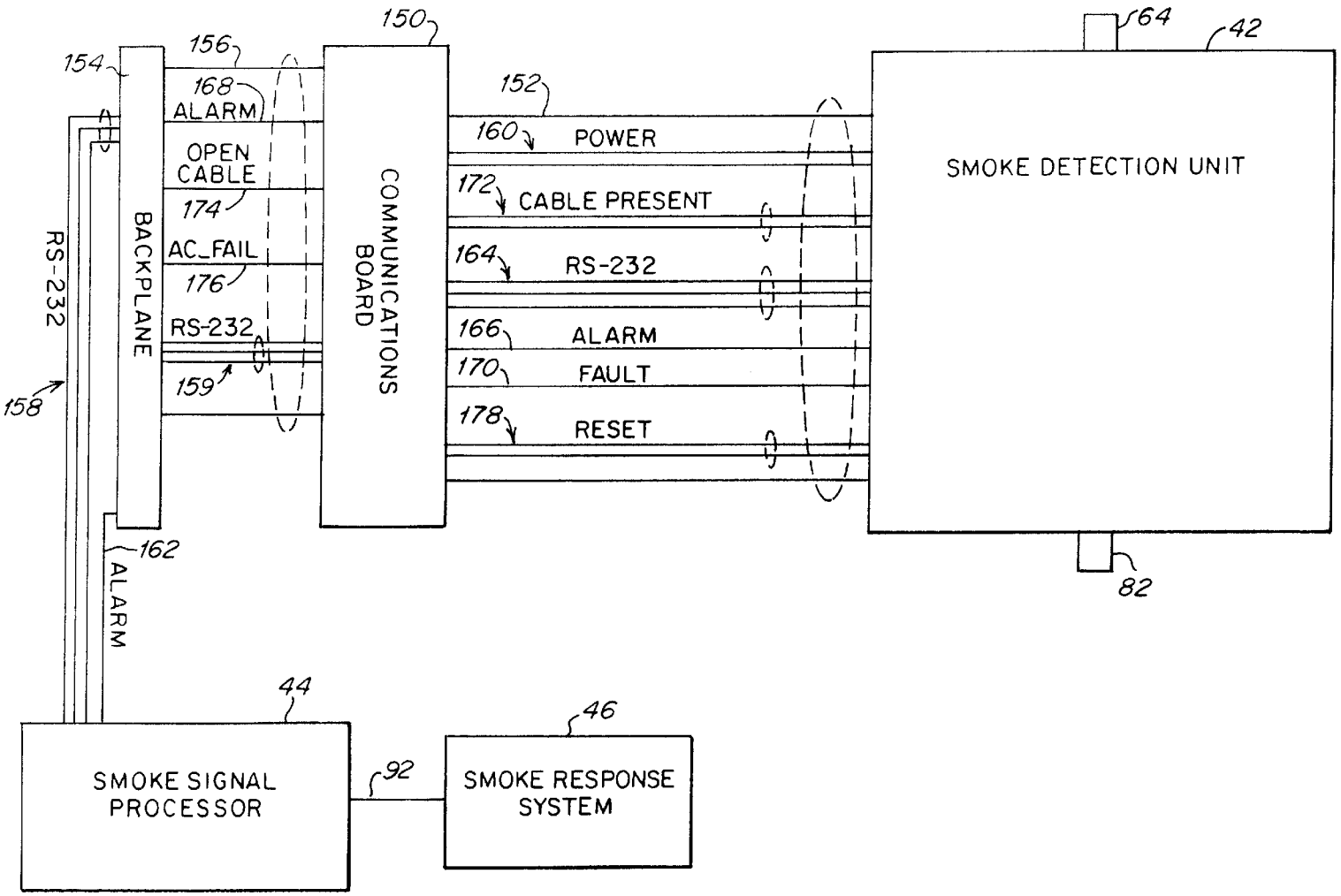
FIG. 9 is a block diagram illustrating implementation of the smoke detection system according to one embodiment of the present invention.

An implementation of the smoke detection system 40 according to one illustrative embodiment of the present invention is shown in FIG. 9. This detection system configuration is particularly suited for implementation with an intelligent storage device such as the Symmetrix line of disk arrays, available from EMC Corporation of Hopkinton, Mass. Implementation of the smoke detection system with Symmetrix is, however, exemplary and not a limitation of the invention. As illustrated, the SDU 42 is coupled to a communications board 150 via a smoke detector cable 152. The communication board 150 is coupled to a backplane 154 board by a power interface bus 156. The smoke signal processor 44 is coupled to the backplane 154 by an RS-232 cable 158, and the smoke response system 46 is coupled to the smoke signal processor 44 by the coupling 92. The smoke detector cable 152 includes a pair of power lines 160 for supplying 5 volts of power to the SDU. Under normal operating conditions, the SDU 42 requires no setup.

The smoke signal processor 44 issues commands, such as configuration commands, to the SDU 42 through the RS-232 cable 158. The commands are forwarded by the backplane 154 to the communications board 150 via RS-232 lines 159 the power interface bus 156 and then to the SDU 42 via the smoke detector cable 152. The smoke signal processor 44 receives information, such as smoke level information, from the SDU 42 through the same path. When the SDU 42 signals a smoke event, as described in more detail below, the smoke signal processor 44 is notified of the smoke event by the backplane 154 through an alarm line 162.

The smoke signal processor 44 may be activated by a human operator by, for example, selecting an "activate" menu choice from within a graphical user interface displayed on a computer monitor. Selecting this menu choice causes the smoke signal processor 44 to instruct the communications board 150, via the RS-232 cable 158, the backplane 154, and the power interface bus 156, to forward all information received along RS-232 lines 164 in the smoke detector cable 152 to the smoke signal processor 44. When the smoke signal processor 44 is running on a personal computer, the smoke signal processor 44 may also, for example, configure the personal computer's serial port settings to match the SDU's serial port settings. When the human operator indicates that he or she is finished interacting with the SDU 42, the smoke signal processor 44 instructs the communications board 150 to stop forwarding information received along the RS-232 lines 164 in the smoke detector cable 152 to the smoke signal processor 44, and changes the personal computer's serial port settings back to their initial state.

When the SDU 42 detects an unacceptable level of smoke, the SDU 42 asserts an alarm signal line 166 within the smoke detector cable 152. When the alarm signal line 166 is asserted, the communications board 150 asserts an alarm line 168 connected between the communications board 150 and the backplane 154. In response, the backplane 154 asserts the alarm line 162 between the backplane 154 and the smoke signal processor 44. In response, the smoke signal processor 44 may, for example, request additional information from the SDU 42, such as the current smoke level reading. Such additional information may be used to verify the occurrence of a smoke event. The smoke signal processor 44 may instruct the smoke response system 46 to take any appropriate action in response to the assertion of the alarm line 162 and receipt of any additional information, as described above. For example the smoke signal processor 44 may instruct the smoke response system 46 to initiate a shutdown sequence to shut down power to the Symmetrix.

When any event other than a smoke event is detected within the SDU 42, the SDU 42 asserts a fault line 170 within the smoke detector cable 152. In a manner similar to that described above with respect to the alarm line 166, when the fault line 120 is asserted, the assertion of the fault line 120 triggers the assertion of the alarm line 168 connected between the communications board 150 and the backplane 154. This, in turn, triggers the assertion of the alarm line 162 between the backplane 154 and the smoke signal processor 44. In response, the smoke signal 44 processor may, for example, request additional information from the SDU 42, such as the current smoke level reading or the status of the alarm line 166 in order to determine whether there has been a smoke event or some other event that may indicate a problem with the detection system 40. The smoke signal processor 44 may instruct the smoke response system 46 to take any appropriate action in response to the assertion of the alarm line 162 and receipt of any additional information, as described above. For example, the smoke signal processor 44 may instruct the smoke response system 46 to generate a call home.

The smoke detector cable 152 also includes a pair of lines, referred to as "cable present" lines 172, which are used by the communications board 150 to determine whether the SDU 42 is properly connected to the communications board 150. When the smoke detector cable 152 is properly connected between the communications board 150 and the SDU 42, the cable present lines 172 form a closed circuit with, for example, a relay in the SDU 42, thereby enabling the communications board 150 to determine whether the SDU 42 is properly connected to the communications board 150. When the communications board 150 determines that the SDU 42 is not properly connected via the smoke detector cable 152, the communications board 150 may assert an open cable line 174 connected between the communications board 150 and the backplane 154, thereby causing the backplane 154 to assert the alarm line 162 between the backplane 154 and the smoke signal processor 44. In response, the smoke signal processor 44 may instruct the smoke response system 46 to take any appropriate action to the assertion of the open cable line 174. For example, the smoke signal processor 44 may instruct the smoke response system 46 to generate a call home.

When the communications board 150 determines that there is a problem with the power supply to the SDU 42, the communications board 150 may assert an AC_FAIL line 176 connected between the communications board 150 and the backplane 154. This causes the backplane 154 to assert the alarm line 162 between the backplane 154 and the smoke signal processor 44. In response, the smoke signal processor 44 may instruct the smoke response system 46 to take any appropriate action to the assertion of the alarm line 162. For example, the smoke signal processor 44 may instruct the smoke response system 46 to generate a call home.

When an alarm or a fault is signaled on the alarm 166 and fault 170 relay lines, respectively, the signals are latched; in other words, the signals on the lines 166 and 170 remain asserted until the SDU 42 is reset. The smoke signal processor 44 can instruct the communications board 150 to reset the SDU 42 by asserting hardware reset lines 178 in the smoke detector cable.

As indicated above, the smoke detection system of the present invention may be implemented with an electronic system that includes a plurality of electronic enclosures, such as the system shown in FIG. 1, situated within a single computer room. Although each electronic enclosure 22 may contain its own SDU 42, smoke signal processor, and smoke response system, it should be understood that this is not necessary and is not a limitation of the present invention. For example, each electronic enclosure may include its own SDU 42, and all of the SDUs may be coupled to one or more external smoke signal processors capable of identifying the electronic enclosure with the information obtained from each SDU 42.

Although various aspects of the invention have been described in terms of a software implementation, it should be understood that aspects of the invention may be implemented in software, hardware, firmware, or any combination thereof. Aspects of the invention may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output.

Suitable processors include, by way of example, both general and special purpose microprocessors. Generally, a processor receives instructions and data from a read-only memory and/or a random access memory. Storage devices suitable for tangibly embodying computer program instructions include for example, all forms of non-volatile memory, such as semiconductor memory devices; including EPROM, EEPROM, and flash memory devices; magnetic disks such as internal hard disks and removable disks; magneto-optical disks; and CD-ROMs. Any of the foregoing may be supplemented by, or incorporated in, specially designed ASICs (application-specific integrated circuits).

A computer can generally also receive programs and data from storage medium such as an internal disk or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium.

As should be apparent from the foregoing description and the accompanying figures, the present invention is directed to a method and apparatus for detecting airborne particles generated within an electronic enclosure that may be indicative of an operational anomaly associated with an electronic component housed within the enclosure. The invention, however, is not limited to any of the particular embodiments or examples described above. For example, the detection system may detect and respond to airborne particles other than smoke particles.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. In a system including a sensor and an electronic enclosure housing at least one electronic component therein, a method comprising steps of:

(A) monitoring an output of the sensor that indicates the presence of an operational anomaly with the at least one electronic component; and (B) when the output of the sensor indicates the presence of an operational anomaly with the at least one electronic component, performing steps of:

(1) determining whether a fault condition is present with respect to the sensor;

(2) disregarding the indication of the presence of an operational anomaly with the at least one electronic component when a fault condition is determined to be present with respect to the sensor; and (3) performing an action with respect to the at least one electronic component when no fault condition is determined to be present with respect to the sensor.

2. The method of claim 1, wherein the sensor comprises an airborne particle detector.

3. The method of claim 2, wherein the step (B)(1) comprises:

attempting to receive information descriptive of airborne particles in air received by the airborne particle detector from the electronic enclosure; and determining that the fault condition is present when the attempt fails.

4. The method of claim 2, wherein the step (B)(1) comprises:

receiving information descriptive of the airborne particle detector;

comparing the received information descriptive of the airborne particle detector to stored information descriptive of the airborne particle detector; and determining that the fault condition is present when the comparison fails.

5. The method of claim 2, wherein the airborne particle detector includes a smoke detector and the output monitored in step (A) is indicative of a combustion event with the at least one electronic component.

6. The method of claim 1, wherein the step (B)(3) comprises initiating a shutdown sequence to terminate power to the at least one electronic component.

7. A computer readable medium encoded with a program for execution on a processor in a detection system for use with a computer system including a sensor and an electronic enclosure housing at least one electronic component therein, wherein the program when executed on the processor, performs a method comprising steps of:

(A) monitoring an output of the sensor that indicates the presence of an operational anomaly with the at least one electronic component; and (B) when the output of the sensor indicates the presence of an operational anomaly with the at least one electronic component, performing steps of:

(1) determining whether a fault condition is present with respect to the sensor;

(2) disregarding the indication of the presence of an operational anomaly with the at least one electronic component when a fault condition is determined to be present with respect to the sensor; and (3) performing an action with respect to the at least one electronic component when no fault condition is determined to be present with respect to the sensor.

8. The computer readable medium of claim 7, wherein the sensor comprises an airborne particle detector.

9. The computer readable medium of claim 8, wherein the step (B)(1) comprises:

attempting to receive information descriptive of airborne particles in air received by the airborne particle detector from the electronic enclosure; and determining that the fault condition is present when the attempt fails.

10. The computer readable medium of claim 8, wherein the step (B)(1) comprises:

receiving information descriptive of the airborne particle detector;

comparing the received information descriptive of the airborne particle detector to stored information descriptive of the airborne particle detector; and determining that the fault condition is present when the comparison fails.

11. The computer readable medium of claim 8, wherein the step (B)(3) comprises initiating a shutdown sequence to terminate power to the at least one electronic component.

12. The computer readable medium of claim 8, wherein the airborne particle detector includes a smoke detector and the output monitored in step (A) is indicative of a combustion event with the at least one electronic component.

13. A detection system for use with a computer system including a sensor and an electronic enclosure housing at least one electronic component therein, the detection system comprising:

a detector to monitor an output of the sensor that indicates the presence of an operational anomaly with the at least one electronic component; and a controller to, when the output of the sensor indicates the presence of an operational anomaly with the at least one electronic component:

determine whether a fault condition is present with respect to the sensor;

disregard the indication of the presence of an operational anomaly with the at least one electronic component when a fault condition is determined to be present with respect to the sensor; and perform an action with respect to the at least one electronic component when no fault condition is determined to be present with respect to the sensor.

14. The detection system of claim 13, wherein the sensor comprises an airborne particle detector.

15. The detection system of claim 14, wherein the controller is further configured to:

attempt to receive information descriptive of airborne particles in air received by the airborne particle detector from the electronic enclosure; and determine that the fault condition is present when the attempt fails.

16. The detection system of claim 14, wherein the controller is further configured to:

receive information descriptive of the airborne particle detector;

compare the received information descriptive of the airborne particle detector to stored information descriptive of the airborne particle detector; and determine that the fault condition is present when the comparison fails.

17. The detection system of claim 14, wherein the controller is further configured to initiate a shutdown sequence to terminate power to the at least one electronic component.

18. The detection system of claim 14, wherein the airborne particle detector includes a smoke detector and the output monitored by the smoke detector is indicative of a combustion event with the at least one electronic component.

* * * * *